US012000673B2

(12) United States Patent
Zimmer

(10) Patent No.: US 12,000,673 B2
(45) Date of Patent: Jun. 4, 2024

(54) MOUNTS FOR OPTICAL SIGHTING DEVICES

(71) Applicant: Trent Zimmer, Broussard, LA (US)

(72) Inventor: Trent Zimmer, Broussard, LA (US)

( * ) Notice: Subject to any disclaimer, the term of this patent is extended or adjusted under 35 U.S.C. 154(b) by 0 days.

(21) Appl. No.: 17/833,997

(22) Filed: Jun. 7, 2022

(65) Prior Publication Data

US 2023/0143303 A1 May 11, 2023

Related U.S. Application Data

(62) Division of application No. 16/375,906, filed on Apr. 5, 2019.

(60) Provisional application No. 62/652,931, filed on Apr. 5, 2018.

(51) Int. Cl.
*F41G 11/00* (2006.01)
*F41G 1/26* (2006.01)

(52) U.S. Cl.
CPC ..... *F41G 11/007* (2013.01); *F41G 1/26* (2013.01)

(58) Field of Classification Search
CPC ..... F41G 11/00; F41G 11/007; F41G 1/00; F41G 1/46
See application file for complete search history.

(56) References Cited

U.S. PATENT DOCUMENTS 1,405,580 A * 2/1922 Green ..... F41G 1/033 42/139
3,742,636 A * 7/1973 Dealy ..... F41G 1/00 42/143
3,961,423 A * 6/1976 Hrebar ..... F41G 1/00 42/137
4,841,659 A * 6/1989 Williams ..... F41G 1/10 D22/109
5,134,798 A * 8/1992 Lee ..... F41G 11/003 42/114
5,806,228 A * 9/1998 Martel ..... F41G 11/003 42/124
6,338,219 B1 * 1/2002 Watson, Jr. ..... F41G 1/08 42/130
7,367,152 B2 5/2008 Samson
7,730,655 B2 6/2010 Spuhr
7,908,782 B1 3/2011 LaRue
8,297,164 B1 * 10/2012 Mensch ..... F41A 7/06 89/1.4
8,424,234 B2 4/2013 Carlson
8,490,315 B2 * 7/2013 Dueck ..... F41G 1/02 42/111
8,510,983 B2 8/2013 Larue
8,578,647 B2 11/2013 Storch et al.
(Continued)

OTHER PUBLICATIONS

Spuhr, Dual Position Accessory Mount [online], [retrieved on Apr. 5, 2019], Retrieved from the internet: <URL: https://www.spuhr.biz/dual-position-accessory-mount>.

*Primary Examiner* — Benjamin P Lee
(74) *Attorney, Agent, or Firm* — Asgaard Patent Services, LLC; F. Wayne Thompson, Jr.

(57) ABSTRACT

Disclosed are implementations of a pivot mount for an optical sighting device. A sight support member of the pivot mount is moveable between an operative position, in which an optical sighting device can be used to sight the firearm on a target, and an inoperative position, in which the optical sighting device is vertically offset below the operative position.

6 Claims, 23 Drawing Sheets

(56) References Cited

U.S. PATENT DOCUMENTS 8,726,562 B1 * 5/2014 Hoskisson ..... F41G 11/003 42/126
8,769,859 B2 * 7/2014 Li ..... F41G 11/003 42/124
8,793,921 B1 * 8/2014 Tonello ..... F41G 11/008 42/125
D728,728 S * 5/2015 Barfoot ..... D22/109
RE45,724 E * 10/2015 Dueck ..... F41G 1/02
9,372,049 B2 * 6/2016 Cheng ..... F41G 1/30
9,417,034 B1 * 8/2016 Swan ..... F41G 11/007
10,030,935 B1 * 7/2018 Ding ..... F41G 1/17
D851,203 S * 6/2019 Ding ..... D22/109
D852,920 S * 7/2019 Ding ..... D22/109
10,634,456 B1 * 4/2020 Fischer ..... F41G 11/003
10,921,079 B1 * 2/2021 Full ..... F41A 17/38
10,989,499 B2 * 4/2021 Connolly ..... F41G 1/17
11,067,365 B2 * 7/2021 Roberson ..... F41G 1/16
11,365,954 B2 * 6/2022 Gerber ..... F41G 11/003
2006/0162227 A1 * 7/2006 Samson ..... F41G 11/008 42/148
2008/0092421 A1 4/2008 Beckmann
2011/0296732 A1 12/2011 Carlson et al.
2012/0060402 A1 * 3/2012 Dueck ..... F41G 1/02 42/137
2013/0160345 A1 6/2013 Li et al.
2013/0185985 A1 * 7/2013 Ballard ..... F41G 11/003 42/148
2014/0123532 A1 * 5/2014 Russ ..... F41G 1/38 42/113
2014/0137457 A1 5/2014 Collin et al.
2014/0150324 A1 * 6/2014 Keng ..... F41G 1/30 42/118
2015/0345901 A1 * 12/2015 Cheng ..... F41C 33/08 42/111
2016/0209176 A1 * 7/2016 Zimmer ..... F41G 11/001
2018/0180386 A1 * 6/2018 Keller ..... F41G 1/04
2022/0113114 A1 * 4/2022 Humphries ..... F41G 1/01

* cited by examiner

MOUNTS FOR OPTICAL SIGHTING DEVICES

CROSS-REFERENCE TO RELATED APPLICATIONS

This is a divisional application claiming the benefit of U.S. patent application Ser. No. 16/375,906, filed on Apr. 5, 2019, which claims the benefit of U.S. Provisional Application Ser. No. 62/652,931, filed on Apr. 5, 2018, the entireties of both applications are incorporated herein by reference.

TECHNICAL FIELD

This disclosure relates to mounts for optical sighting devices. In particular, the present disclosure is directed to implementations of an optical sight mount that includes an integrated backup sighting system, and to implementations of a pivot mount that permits an optical sighting device to be selectively employed in series with a primary optical sighting device.

BACKGROUND

Firearms, such as rifles, are often used in conjunction with an optical sighting device, such as a reflex sight or a telescopic sight. While optical sighting devices are widely used by warfighters, police, and civilians as a primary sighting system, many users still desire to position mechanical sights on their firearm that serve as a backup sighting system should the primary sighting system fail. These mechanical sights, typically referred to as "iron sights", are often selectively adjustable by the user so that fired bullets strike as close as possible to a point of aim.

A rifle equipped with an optical sighting device, such as a reflex sight or a telescopic sight, is often used in combination with a secondary optical sighting device, such as a magnifier or a night vision device. These secondary optical sighting devices are usually positioned to enhance the capabilities of the primary sighting system (e.g., a magnifier used in conjunction with a reflex sight) or to serve as a backup sighting system should the primary fail, or otherwise be rendered inoperable (e.g., an optical sighting device, such as a reflex sight, that it laterally offset from the primary optical sighting device, such as a telescopic sighting device).

It is often desirable to rapidly position a secondary optical sighting device, such as a magnifier, for use with a primary sighting system, such as a reflex sight. Similarly, it is desirable to rapidly reposition such a sighting deice out of the way, or remove it, when it is not needed. For those reasons, secondary optical sighting devices, such as magnifiers, are often positioned on a rifle by a mount that allows the optical sighting device to be selectively positioned behind (or in series with) the primary sighting system. Many of these mounts allow the secondary optical sighting device to be laterally offset while not being used. However, as will be discussed in greater detail below, mounts configured to laterally offset the optical sighting device when not in use have several disadvantages.

Accordingly, it can be seen that needs exist for the mounts for optical sighting devices disclosed herein. It is to the provision of mounts for optical sighting devices that are configured to address these needs, and others, that the present invention(s) are primarily directed.

SUMMARY OF THE INVENTION

Disclosed are implementations of a pivot mount for an optical sighting device. A sight support member of the pivot mount is moveable between an operative position, in which an optical sighting device can be used to sight the firearm on a target, and an inoperative position, in which the optical sighting device is vertically offset below the operative position.

An example pivot mount comprises a base configured to releasably engage a mounting interface, and a sight support member rotatably coupled to the base. The sight support member is configured to move the optical sighting device between a first position, in which the optical sighting device is aligned with the sighting axis of the firearm, and a second position, in which the optical sight device is vertically offset below the sighting axis of the firearm and positioned over the mounting interface.

Another example pivot mount comprises a base configured to releasably engage a mounting interface, and a sight support member rotatably coupled to the base.

The sight support member is configured to move a longitudinal axis of the optical sighting device between a first position, in which the optical sighting device is in a use position, and a second position, in which the optical sighting device is in a storage position, with both the first and the second positions being located substantially on a vertical plane that is substantially co-aligned with the sighting axis of the firearm.

Yet another example pivot mount comprises a base configured to releasably engage a mounting interface, and a sight support member rotatably coupled to the base. The sight support member is configured to move the optical sighting device between a first position, in which the optical sighting device is in an operative position, and a second position, in which the optical sighting device is in an inoperative position, with both the first and the second positions placing the optical sighting device over the mounting interface, and in which the second position is located below the first position.

BRIEF DESCRIPTION OF THE DRAWINGS

Like reference numerals refer to corresponding parts throughout the several views of the drawings.

DETAILED DESCRIPTION

Figure 1:
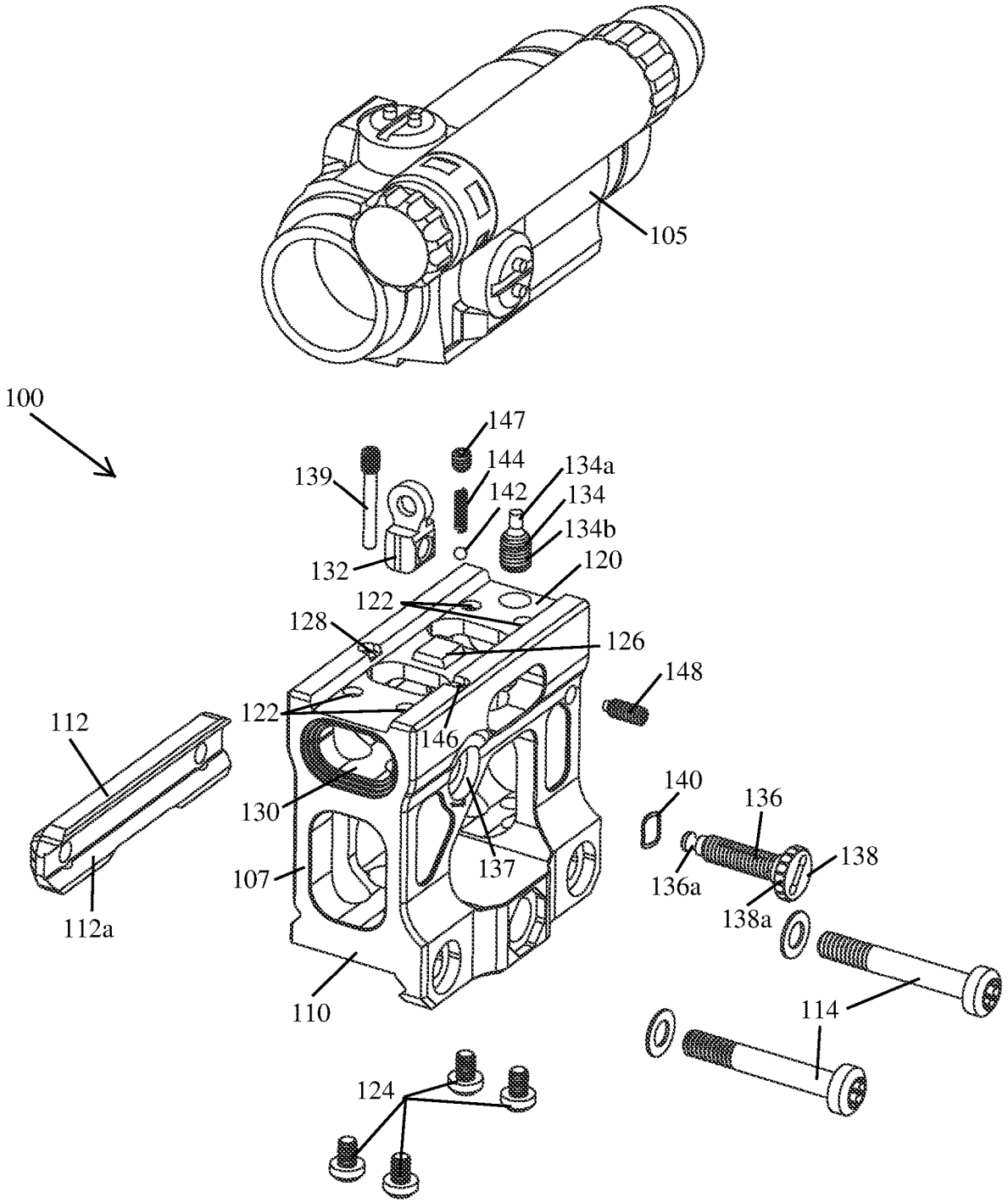
FIG. 1 illustrates an exploded view of an example optical sight mount with an integrated backup sighting system 100 according to the principles of the present disclosure.
Figure 2:
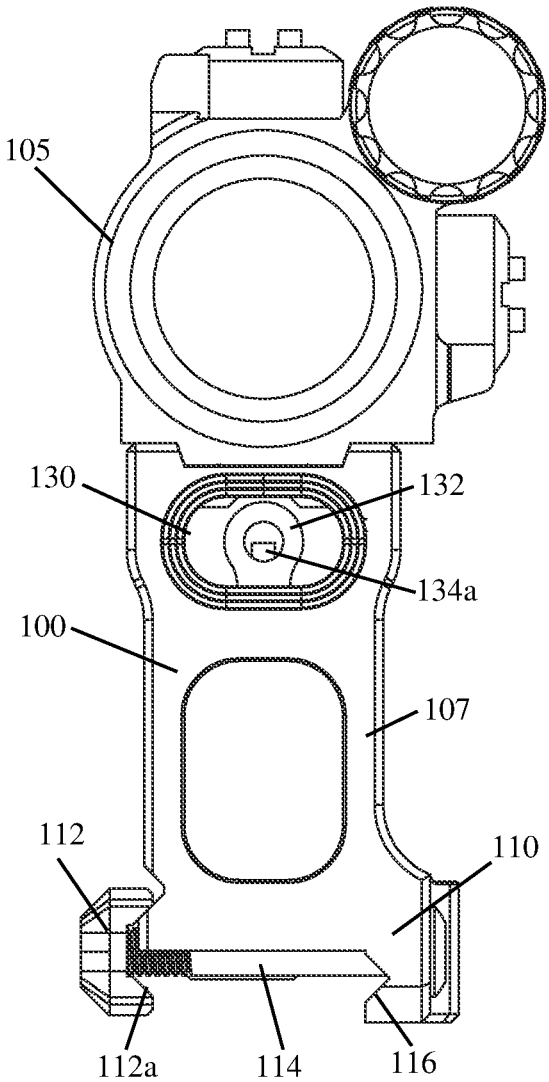
FIG. 2 illustrates a back side view of the optical sight mount 100 shown in FIG. 1, wherein an optical sighting device 105 has been secured thereto.
Figure 3:
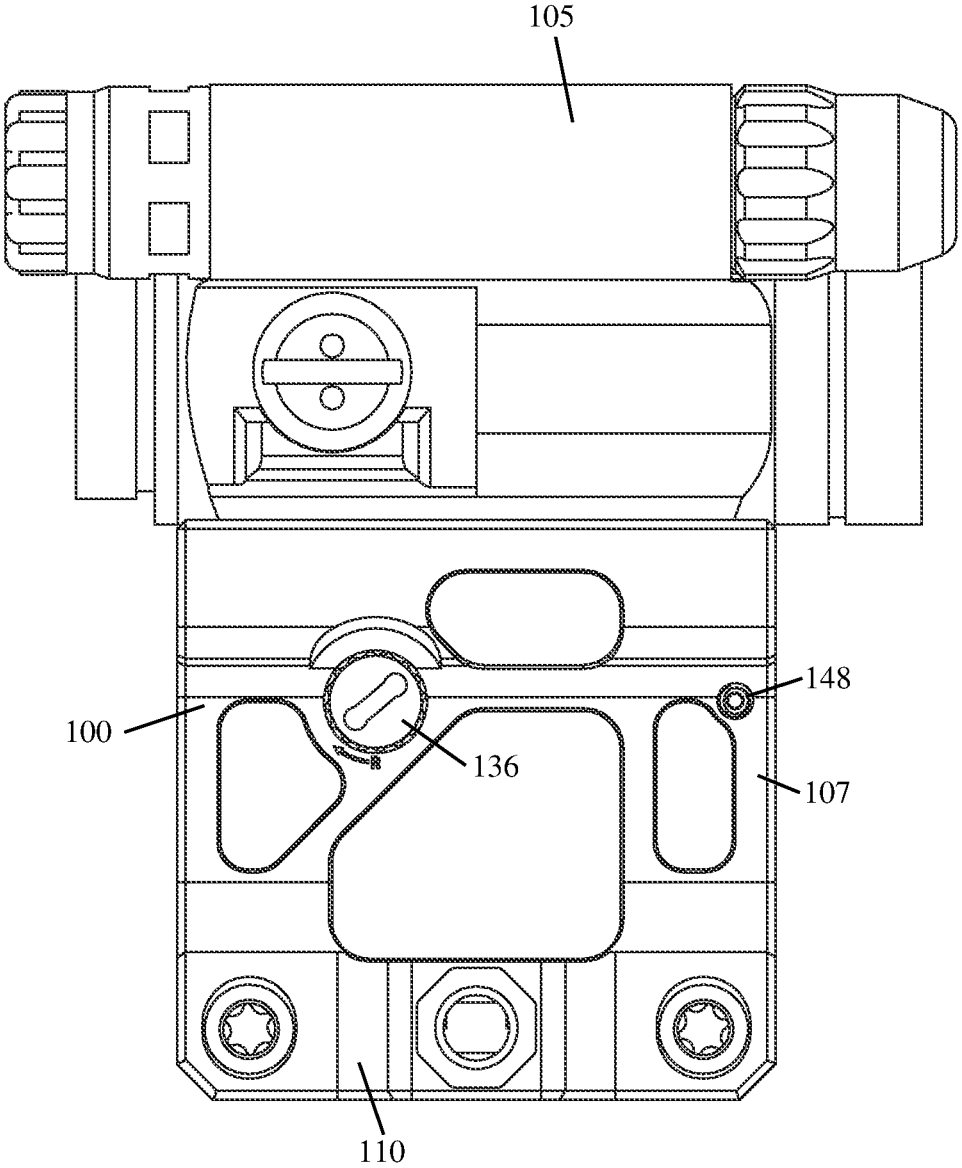
FIG. 3 illustrates a right side view of the optical sight mount 100 shown in FIG. 2.

FIGS. 1-3 illustrate an example implementation of an optical sight mount with an integrated backup sighting system 100 according to the principles of the present disclosure. The optical sight mount 100 is configured to position an optical sighting device 105 (e.g., a reflex sight such as an Aimpoint® CompM5, or a holographic sight) on a firearm (e.g., a rifle) so that it can be used to aim the firearm. Further, the backup sighting system can be used to aim the firearm should the optical sighting device 105 fail, or otherwise be rendered inoperable.

Figure 4:
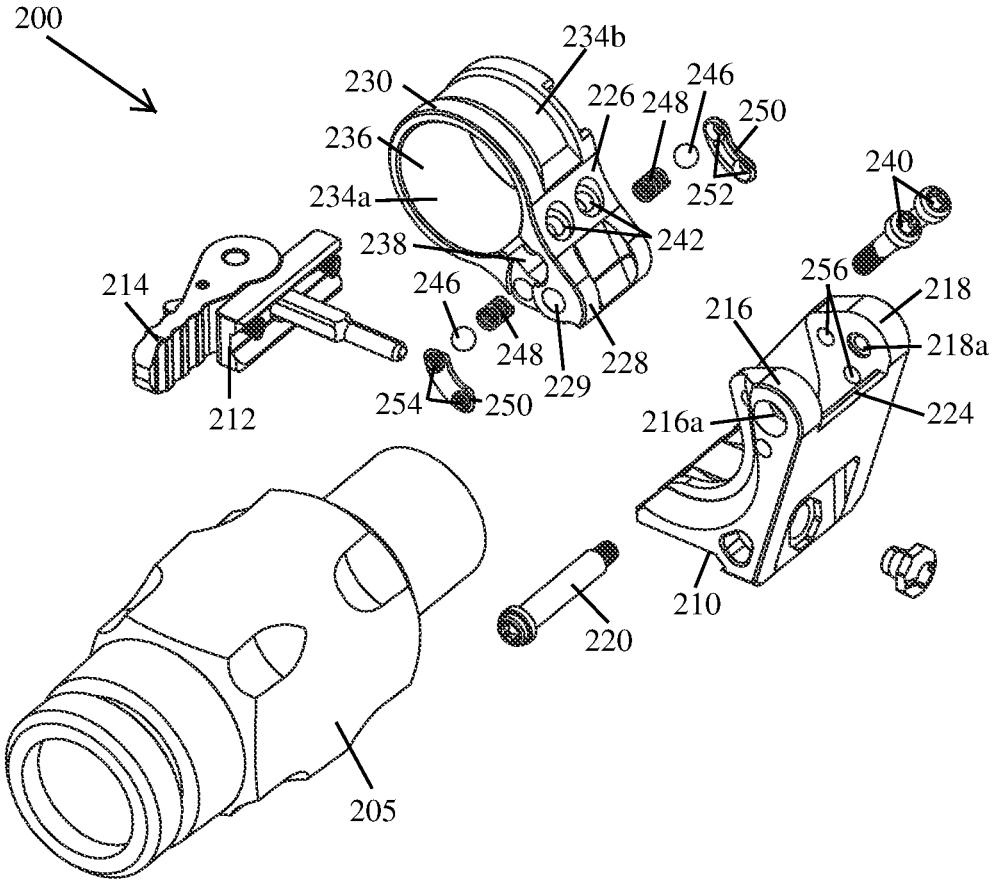
FIG. 4 illustrates an exploded view of an example pivot mount 200 for an optical sighting device according to the principles of the present disclosure.
Figure 5:
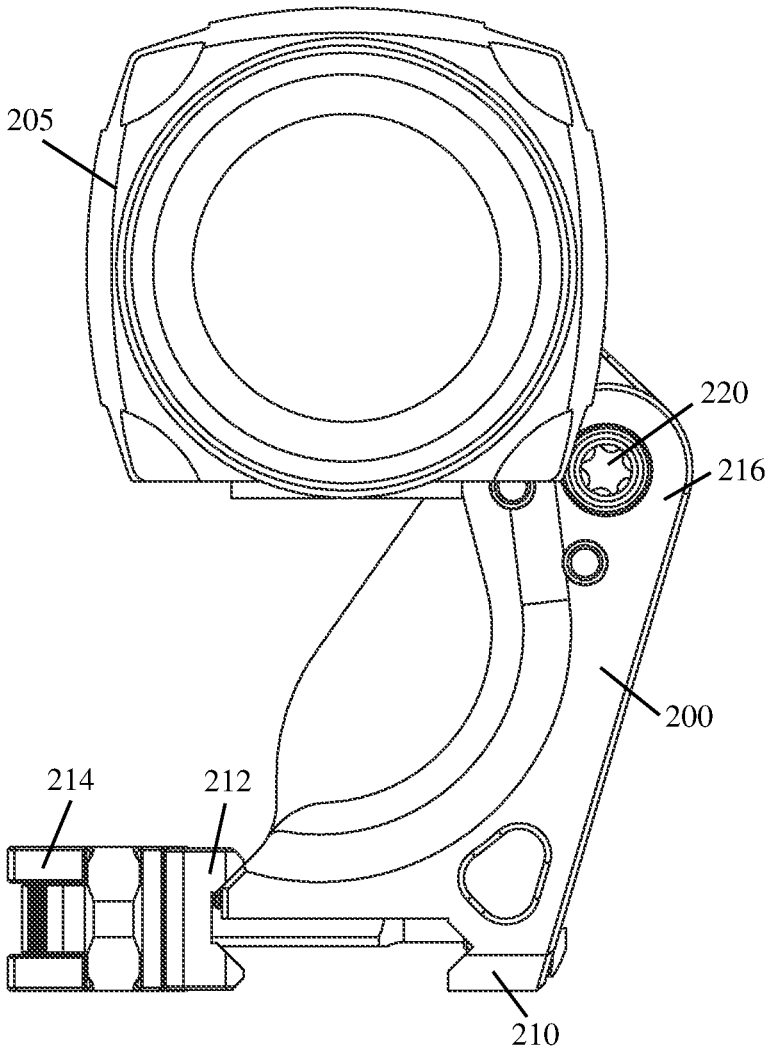
FIG. 5 illustrates a back side view of the pivot mount 200 shown in FIG. 4, wherein an attached optical sighting device 205 is in the operative position.
Figure 6:
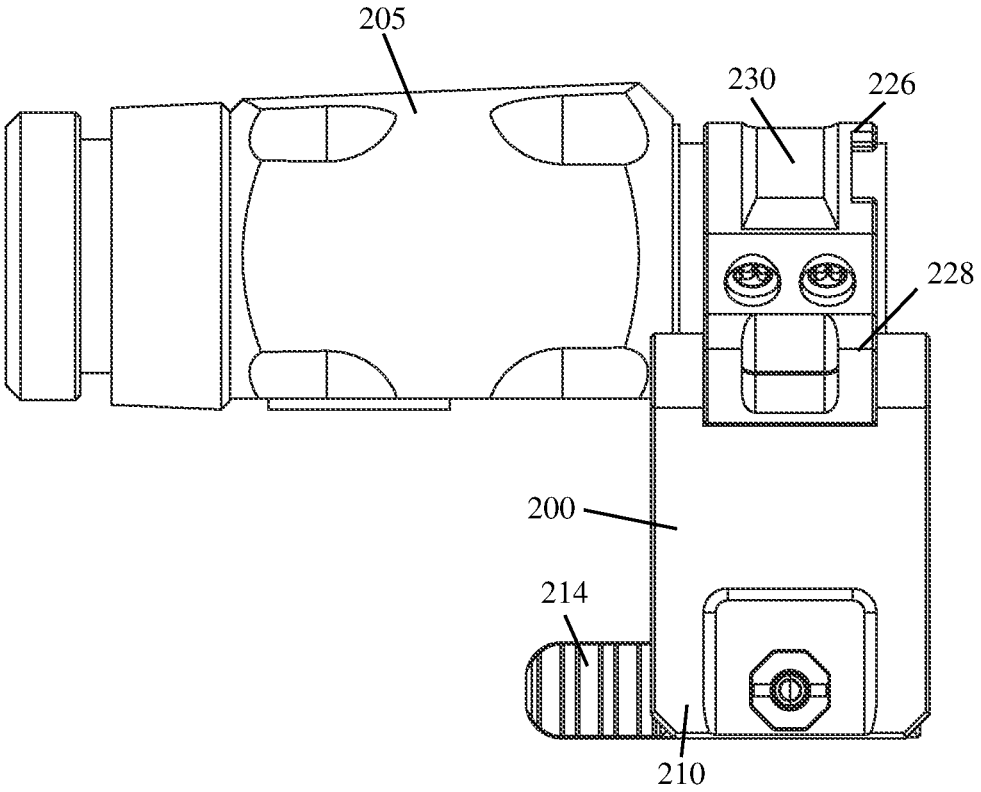
FIG. 6 illustrates a right side view of the pivot mount 200 shown in FIG. 5.

FIGS. 4-6 illustrate an example implementation of a pivot mount 200 for optical sighting devices (e.g., a telescope or magnifier, a night vision device, a thermal imager, etc.) according to the principles of the present disclosure. In some implementations, the pivot mount 200 is moveable between an operative position wherein an optical sighting device 205 (e.g., an Aimpoint® magnifier) can be used to sight the firearm on a target (see, e.g., FIGS. 7-9) and an inoperative position wherein the optical sighting device 205 is positioned below, or vertically offset from, the operative position (see, e.g., FIGS. 10-12).

FIGS. 7-12 illustrate how the optical sight mount 100 and the pivot mount 200 may be used to position a pair of optical sighting devices 105, 205 in tandem (or in series) on a firearm. In some implementations, when the pivot mount 200 is in the operative position, the secondary optical sighting device 205 may be used in conjunction with the primary optical sighting device 105 to aim the firearm at a target (see, e.g., FIGS. 7-9). In some implementations, when the pivot mount 200 is in the inoperative position, the secondary optical sighting device 205 is removed from behind the primary optical sighting device 105 which can still be used to aim the firearm at a target (see, e.g., FIGS. 10-12).

In some implementations, an optical sighting device secured to the optical sight mount 100 and an optical sighting device secured to the pivot mount 200, independent of the other, may be used to aim a firearm.

As shown in FIGS. 1-3, in some implementations, the optical sight mount 100 may comprise a base 110 configured to be secured to, or removed from, a mounting interface 102 of a firearm (e.g., a MIL-STD-1913 rail); a mounting surface 120 configured so that an optical sighting device 105 can be secured thereon; and a backup sighting system positioned within a longitudinally extending sight channel 130 located between the base 110 and the mounting surface 120. In some implementations, the body 107 of the optical sight mount 100 may be substantially rectangular-shaped.

As shown in FIGS. 1 and 2, in some implementations, the base 110 of the optical sight mount 100 may comprise a moveable clamp member 112 that can be moved into and out of engagement with the mounting interface 102 of a firearm (e.g., a MIL-STD-1913 rail) by a pair of bolts 114. In this way, the optical sight mount 100 can be secured and retained on the mounting interface 102 of a firearm (see, e.g., FIGS. 7 and 8). In some implementations, the clamp member 112 is connected to the base 110 by bolts 114, each of which is threaded at its end to permit adjustment of the distance between the receiving groove 116 of the base 110 and the receiving groove **112*a* of the clamp member 112. In some implementations, the receiving groove 116 of the base 110 and the receiving groove 112*a* of the clamp member 112 are configured to receive opposing portions of the mounting interface 102** therein.

The clamping mechanism used to secure the base 110 of an optical sight mount 100 to a mounting interface 102 of a firearm is not critical to the design of the present invention. Therefore, the base 110 of an optical sight mount 110 could be configured to include another clamping mechanism, known to one of ordinary skill in the art, that is capable of releasably securing the optical sight mount 100 to the mounting interface 102 of a firearm (e.g., an embodiment of the locking release clamp assembly disclosed in U.S. Pat. No. 8,578,647 to Troy Storch et al.).

As shown in FIG. 1, in some implementations, the mounting surface 120 of the optical sight mount 100 may comprise a relief (or channel) configured to receive at least a portion of an optical sighting device 105 therein. In some implementations, the mounting surface 120 may not include a relief (not shown). In some implementations, the mounting surface 120 may be configured (e.g., contoured, shaped, etc.) to interface with the mount compatible surface (e.g., the bottom side) of any suitably configured optical sighting device. In some implementations, the mounting surface 120 may include one or more openings 122 that extend therethrough. In this way, fasteners 124 (e.g., screws) may be used to secure an optical sighting device 105 to the mounting surface 120 of the optical sight mount 100. In some implementations, the mounting surface 120 may include at least one recoil lug 126 thereon. In some implementations, each recoil lug 126 may be a projection extending from the mounting surface 120 of the optical sight mount 100 that is configured to interface with a receptacle in the underside of the optical sighting device 105. In this way, an attached optical sighting device may be prevented from sliding back-and-forth due to the incidental vibration associated with the discharge of a firearm. In some implementations, the mounting surface 120 may not have a recoil lug 126 thereon.

As shown in FIGS. 1 and 2, in some implementations, the backup sighting system may comprise a windage adjustable rear sight assembly and an elevation adjustable front sight assembly that are positioned within the longitudinally extending sight channel 130 of the optical sight mount 100. In some implementations, the backup sighting system may be used to aim a firearm in lieu of the optical sighting device 105.

As shown in FIG. 1, in some implementations, the rear sight assembly may include a windage adjustable rear sight 132 positioned within a slot of the longitudinally extending sight channel 130 by a windage adjustment screw 136 that extends therethrough. In some implementations, the rear sight 132 defines a sighting aperture, but could be configured to provide a notch. In some implementations, the windage adjustment screw 136 includes an adjustment knob 138 (or head) that has a partially threaded shaft extending therefrom. In some implementations, the shaft of the windage adjustment screw 136 extends through the optical sight mount 100 via an opening 137 in the body 107 of the optical sight mount 100. In some implementations, the windage adjustment screw 136 may be fixed in positioned by a capture pin 139, or other suitable fastener, extending through an opening 128 in the body 107 of the optical sight mount 100 to interface with a circumferential groove 136*a* on an end thereof. In some implementations, a wave spring 140 may be positioned about, or adjacent to, the circumferential groove 136 of the windage adjustment screw 100 to provide tension thereto. In some implementations, the adjustment knob 138 of the windage adjustment screw 136 includes detent cavities 138*a* about the periphery thereof that interface with a detent ball 142 biased by a detent spring 144 housed within a transverse bore 146 in the optical sight mount 100. In this way, the adjustment knob 138 may be kept from unintentionally rotating. In some implementations, the detent ball 142 and detent spring 144 may be held within the transverse bore 146 by a set screw 147, or other suitable fastener. In some implementations, rotating the adjustment knob 138 clockwise and counterclockwise causes the rear sight 132 to move laterally, within the sight channel 130, on the threaded shaft of the windage adjustment screw 136. In this way, windage adjustments may be made.

As shown in FIGS. 1 and 2, in some implementations, the front sight assembly may include a threaded front sight 134 positioned within the longitudinally extending sight channel 130 so that the post portion 134*a* thereof can be aligned with the aperture of the rear sight 132. In some implementations, the front sight 134 may include a socket in the underside thereof (not shown) that is configured to receive an end of a hex key therein. In some implementations, a hex key may be used to rotate the front sight 134 clockwise and counterclockwise, thereby moving the post portion 134*a* up and down within the sight channel 130. In this way, elevation adjustments may be made. In some implementations, once the desired elevation of the front sight post 134*a* has been set, a capture screw 148 may be used to secure the front sight 134 against unintentional rotation. In some implementations, the capture screw 148 may be configured so that an end thereof bears against the threaded portion 134*b* of the threaded front sight 134.

In some implementations, the front sight assembly may be omitted from the optical sight mount 100 and the rear sight assembly thereof used in conjunction with a front sight mounted above (e.g., on the handguard), or to, the barrel to aim a firearm (not shown).

Figure 7:
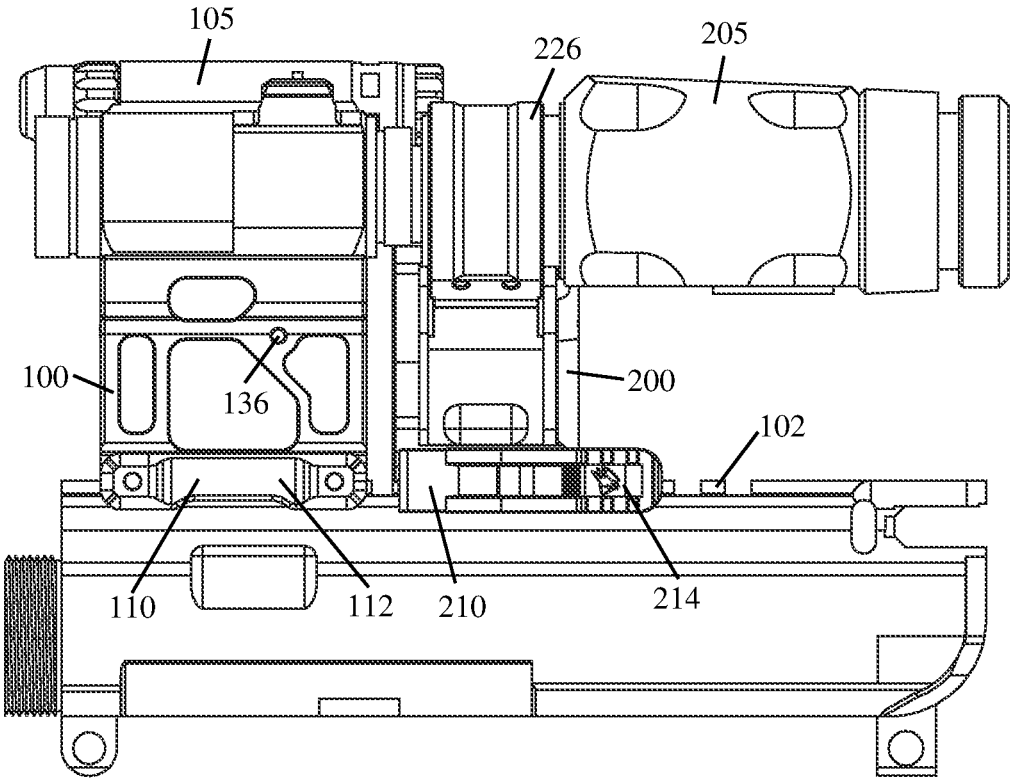
FIGS. 7-9 illustrates the optical sight mount 100 shown in FIG. 2 and the pivot mount 200 shown in FIG. 5 positioned in tandem on the mounting interface 102 of a firearm; the optical sighting device 205 held by the pivot mount 200 is aligned with the sighting axis of the optical sighting device 105 secured to the optical sight mount 100.
Figure 8:
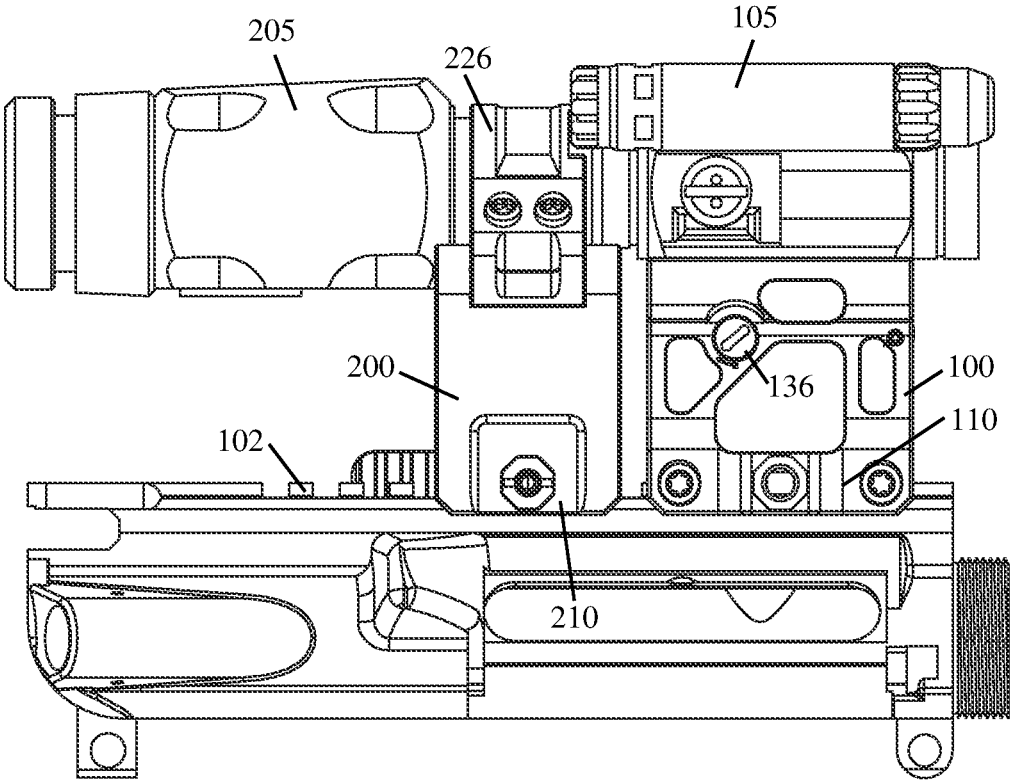
Figure 9:
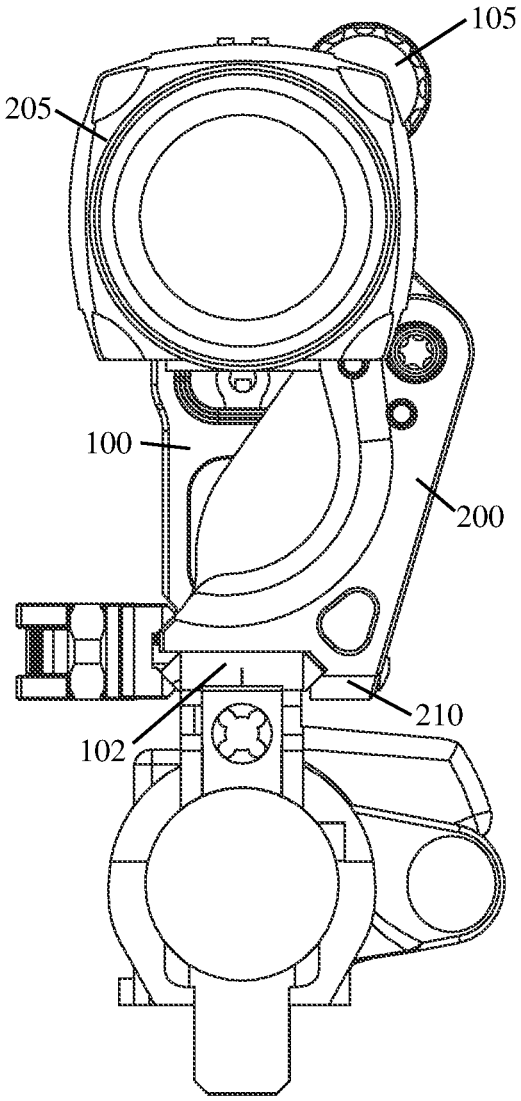

As shown in FIGS. 7 and 8, in some implementations, the optical sight mount 100 may be configured to position the optical sighting device 105 so that the centerline thereof is ~2.26" above the top of the mounting interface 102 on which it is mounted. In some implementations, the optical sight mount 100 may be configured to position the optical sighting device 105 so that the centerline thereof is less than, or more than, 2.26" above the top of the mounting interface 102 on which it is mounted (not shown).

In some implementations, the body 107 of the optical sight mount 100 may be made of aluminum, or another material that is suitably wear and impact resistant.

In some implementations, one or more components of the backup sighting system may be made of aluminum, steel, or another material that is suitably wear and impact resistant.

Figure 10:
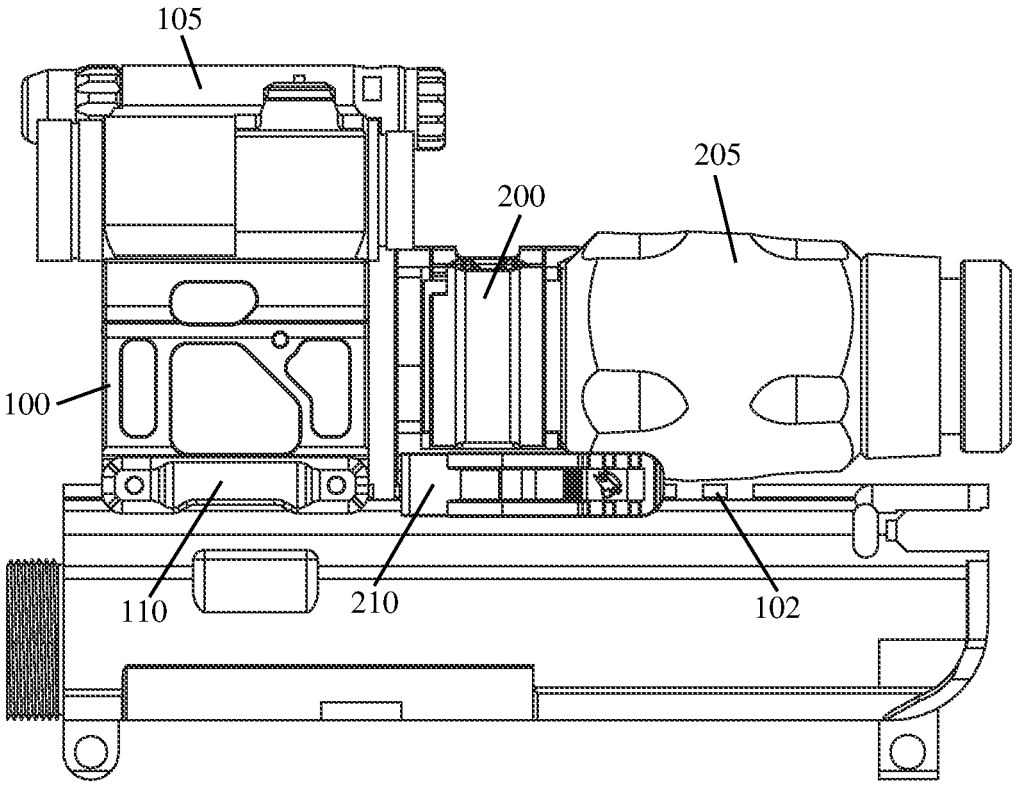
FIGS. 10-12 illustrates the optical sight mount 100 shown in FIG. 2 and the pivot mount 200 shown in FIG. 5 positioned in tandem on the mounting interface 102 of a firearm; the optical sighting device 205 held by the pivot mount 200 has been vertically offset from the sighting axis of the optical sighting device 105 secured to the optical sight mount 100.
Figure 11:
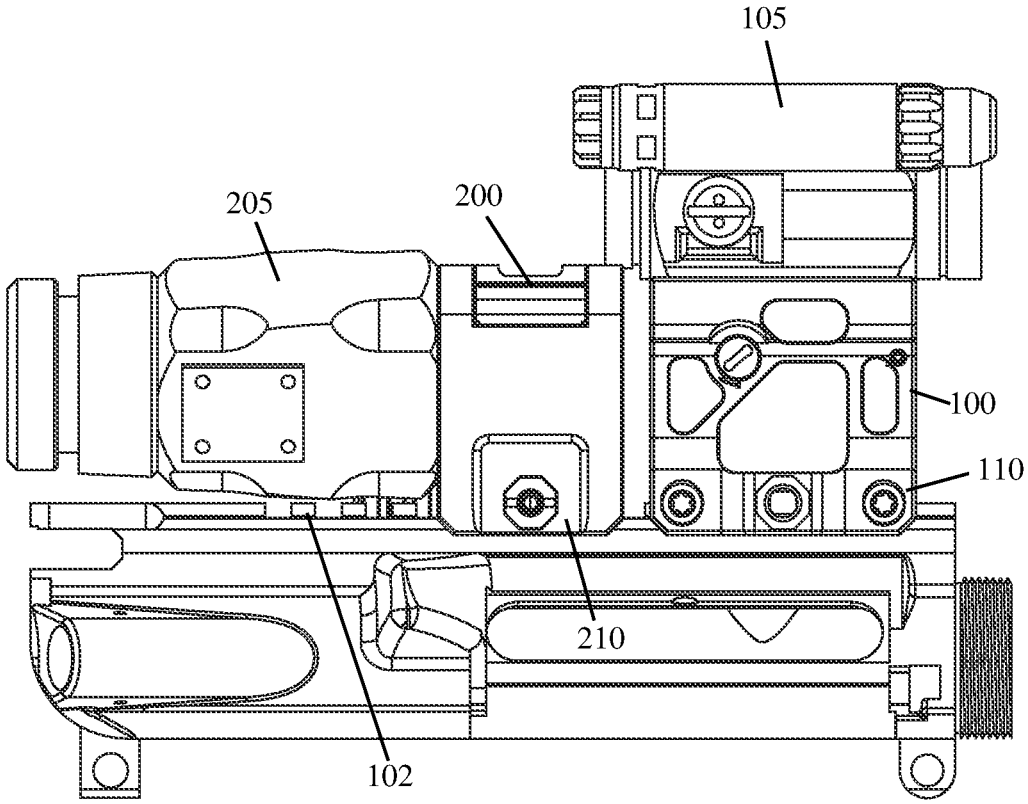
Figure 12:
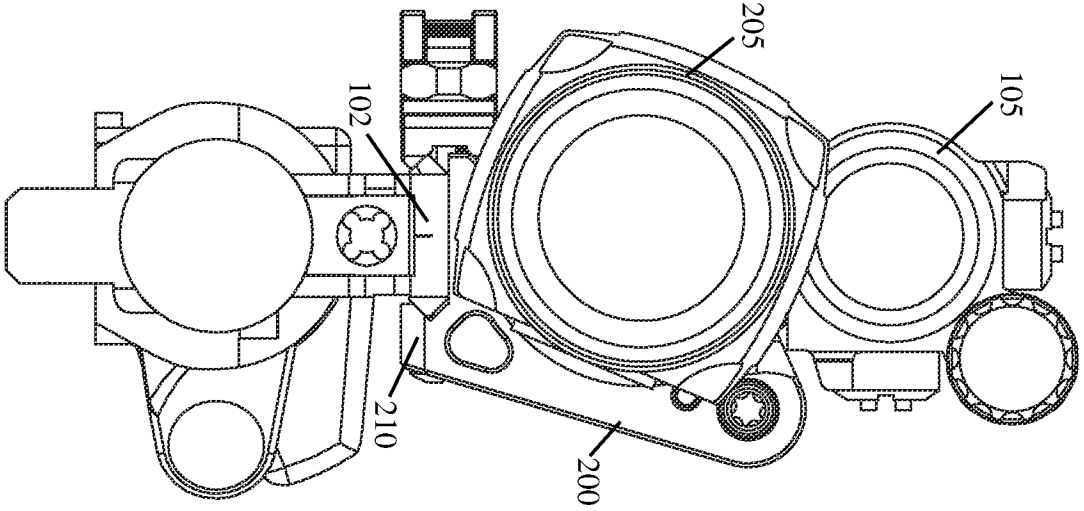

As shown in FIGS. 4-6, in some implementations, the pivot mount 200 for optical sighting devices may comprise a base 210 that can be secured to, or removed from, a mounting interface 102 of a firearm (e.g., a MIL-STD-1913 rail); and a sight support member 226, rotatably coupled to the base 210, that is configured to move an attached optical sighting device 205 between an operative position (see, e.g., FIGS. 7-9) and an inoperative position (see, e.g., FIGS. 10-12). In some implementations, the pivot mount 200 may be configured so that the sight support member 226 moves the attached optical sighting device 205 between two positions on the same, or substantially the same, vertical plane. In this way, when in the operative position and the inoperative position, the optical sighting device 205 is positioned directly above the mounting interface 102 of a firearm on which it is mounted (see, e.g., FIGS. 9 and 12).

As shown in FIG. 5, in some implementations, the base 210 of the pivot mount 200 may be shaped for mounting on a MIL-STD-1913 rail (also referred to as a Pica tinny rail). In some implementations, the base 210 of the pivot mount 200 may comprise a clamp member 212 that can be moved into and out of engagement with the mounting interface 102 of a firearm (e.g., a MIL-STD-1913 rail) by a lever arm 214. The general features and advantages of a base 210 having the clamp member 212 and lever arm 214 disclosed herein are described in connection with one or more embodiments of the locking release clamp assembly disclosed in U.S. Pat. No. 8,578,647 to Troy Storch et al., the entirety of which is incorporated herein by reference.

The clamping mechanism used to secure the base 210 of a pivot mount 200 to a mounting interface 102 of a firearm is not critical to the design of the present invention. Therefore, the base 210 of a pivot mount 200 could be configured to include another clamping mechanism, known to one of ordinary skill in the art, that is capable of securing the pivot mount 200 to the mounting interface 102 of a firearm (e.g., the clamping mechanism shown in connection with the optical sight mount shown in FIGS. 1-3).

As shown in FIG. 4, in some implementations, a pair of spaced pivot bosses 216, 218 project upwardly from the base 210 of the pivot mount 200. In some implementations, each pivot boss 216, 218 includes a bore 216*a*, 218*a* into which a portion of a pivot pin 220 extends. In some implementations, the pivot pin 220 includes a head that has a partially threaded shaft extending therefrom. In some implementations, the head portion of the pivot pin 220 is nested within the bore 216*a* of the first pivot boss 216, while the threaded portion of the shaft is secured within the threaded bore 218*a* of the second pivot boss 218. In some implementation, the pivot bosses 216, 218 define a space, or gap 224, therebetween.

As shown in FIGS. 4 and 6, in some implementations, the sight support member 226 may comprise a pivot portion 228 and a sight attachment device 230 configured to fit closely about a cylindrical barrel portion of the optical sighting device 205.

As shown in FIGS. 4-6, in some implementations, the pivot portion 228 of the sight support member 226 is configured to be rotatably positioned between the pivot bosses 216, 218 of the base 210 and held there by the pivot pin 220. In some implementations, a bore 229 extends through the pivot portion 228 of the sight support member 226 that is configured to accommodate the unthreaded portion of the pivot pin 220 shaft. In this way, while the pivot pin 220 is holding the pivot portion 229 of the sight support member 226 in position between the pivot bosses 216, 218 of the base 210, the sight support member 226 can rotate about the unthreaded portion of the pivot pin 220 shaft.

As shown in FIGS. 4 and 6, in some implementations, the sight attachment device 230 of the sight support member 226 may define ring sections 234*a*, 234*b* that define a generally cylindrical opening 236 sized to fit closely about the cylindrical barrel portion of the optical sighting device 205. In some implementations, the ring sections 234*a*, 234*b* of the sight attachment device 230 may define a gap 238 therebetween. In some implementations, screws 240, or other suitable fasteners, may be received within openings 242 in the sight support member 224 and tightened to draw the portions of the ring sections 234*a*, 234*b* adjacent the gap 238 towards one another, thereby developing a clamping force sufficient to secure the optical sighting device 205 against inadvertent movement within the cylindrical opening 236. In some implementations, the ring sections 234*a*, 234*b* are somewhat flexible even through they are fabricated from a metal material such as aluminum, or another suitably flexible metal alloy (e.g., a steel alloy, a titanium alloy, etc.).

In some implementations, the sight attachment device 230 of the sight support member 226 may be configured to accommodate different optical sighting devices (e.g., a night vision device and/or a thermal imager) being secured thereto (not shown).

As shown in FIG. 4, in some implementations, the pivot mount 200 further comprises a pair of spring-loaded ball detents 246 configured to releasably retain the sight support member 226 in the operative position (see, e.g., FIGS. 7-9) and the inoperative position (see, e.g., FIG. 10-12). In some implementations, each ball detent 246, and the spring 248 used to bias it into position, is carried in the pivot portion 228 of the sight support member 226. In some implementations, each ball detent 246 is received in a pair of corresponding recesses 252 formed in a detent plate 250 positioned on the interior side of each pivot boss 216, 218. In this way, due to the resistance provided by the ball detents 246 being held in frictional engagement with a recess of each detent plate 250, the spring-loaded ball detents 246 are able to secure the sight support member 226 in the operative position (see, e.g., FIGS. 7-9) and the inoperative position (see, e.g., FIG. 10-12). The movement of the sight support member 226 relative to the base 210 and the mounting interface 102 can be accomplished without manipulation of a latch, lever, or other similar device. In some implementations, the detent plate 250 may include a guide groove that connects the pair of recesses 252 defined thereby. The guide groove is configured to facilitate the smooth transition of a ball detent 246 between recesses 252. In some implementations, the backside of each detent plate 250 may include two cylindrical bosses 254 that are received by corresponding openings 256 found on the interior side of each pivot boss 216, 218. In this way, a detent plate 250 may be positioned on the interior side of each pivot boss 216, 218 to interface with the spring-loaded ball detents 246. In some implementations, each detent plate 250 may be made of steel, or another suitably wear resistant material, instead of aluminum. This should increase the service life of the part.

In some implementations, the base 210 and the sight support member 226 of the pivot mount 200 may be made of aluminum, or another material that is suitably wear and impact resistant.

It should be noted that keeping the optical sighting device 205 positioned above the mounting interface 102 of a firearm when not in use (i.e., the inoperative position) offers several advantages over other pivot mounts in which the optical sighting device, when not in use, is laterally offset from the mounting interface. For example, as compared to a laterally offset optical sighting device, the front lens of the optical sighting device 205 is less likely to impact another object, the optical sighting device 205 is less likely to tangle or get hung up on environmental obstacles during use, and the optical sighting device 205 does not obstruct the peripheral vision of the operator using the firearm to which the pivot mount 200 is attached.

In some implementations, a pivot mount could be configured so that the pivot point between the sight support member and the base is perpendicular to the longitudinal axis of the firearm on which the pivot mount is secured. In this way, an attached optical sighting device would travel along a longitudinally extending vertical plane when moved between the operative position and the inoperative position.

FIGS. 13-17 illustrate another example implementation of an optical sight mount 300 according to the principles of the present disclosure. In some implementations, the optical sight mount 300 is similar to the optical sight mount 100 discussed above but comprises a base 310 configured to be secured to, or removed from, a mounting interface of a firearm (e.g., a MIL-STD-1913 rail); a mounting surface 320 configured so that an optical sighting device 305 can be secured thereon; and a laterally offset rear sight module 360 that is removably secured to a side of the optical sight mount 300.

Figure 13:
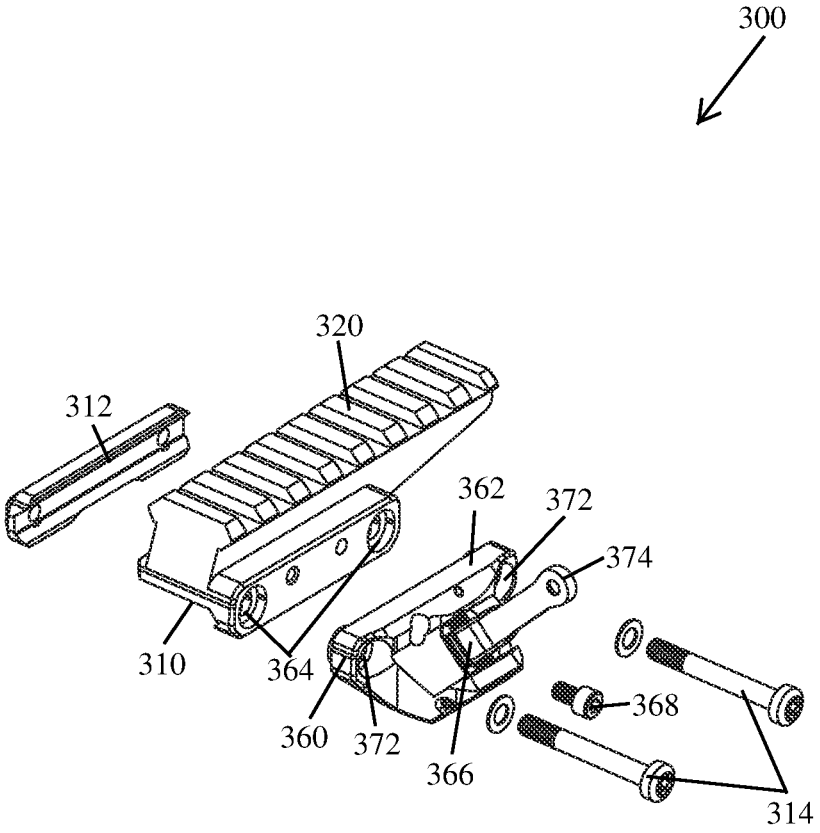
FIGS. 13 and 14 illustrates an exploded view of another example optical sight mount 300 according to the principles of the present disclosure.
Figure 14:
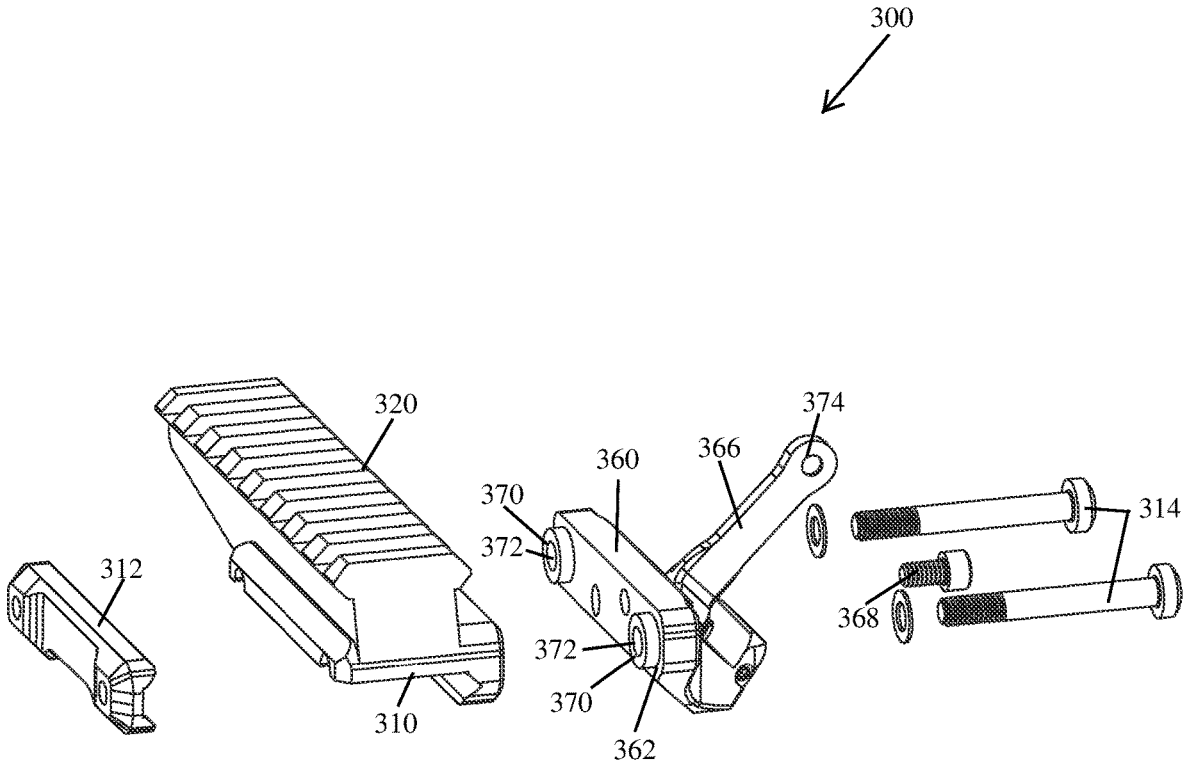

As shown in FIGS. 13 and 14, in some implementations, the base 310 of the optical sight mount 300 may be similar to the base 110 of the optical sight mount 100 shown in FIGS. 1-3, but has been configured so that the bolts 314, used to move the clamp member 312 into and out of engagement with the mounting interface of a firearm, can be used to secured the rear sight module 360 to a side of the optical sight mount 300.

Figure 15:
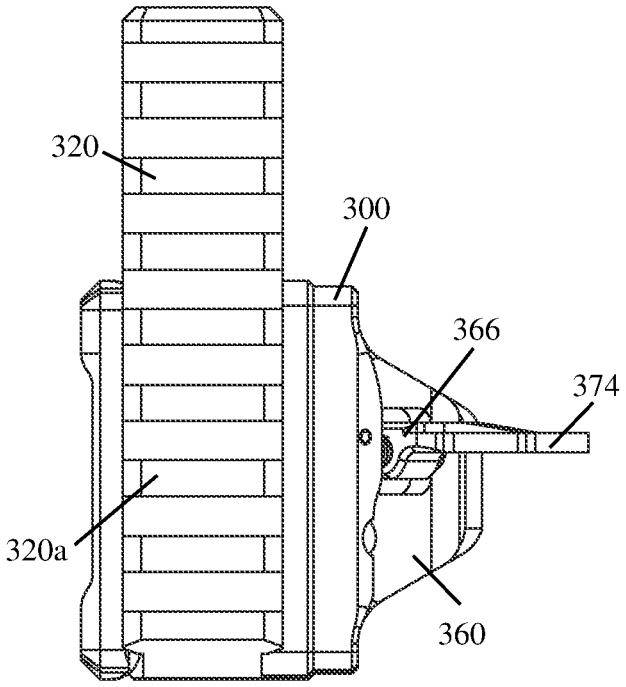
FIG. 15 illustrates a top view of the optical sight mount 300 shown in FIGS. 13 and 14.

As shown in FIGS. 13-15, in some implementations, the mounting surface 310 of the optical sight mount 300 may be a rail interface (e.g., a MIL-STD-1913 rail or "Pica tinny rail"). In this way, an optical sighting device 305 (e.g., a holographic sight such as an EOTech® weapon sight) may be secured thereon (see, e.g., FIG. 16).

As shown in FIGS. 13 and 14, in some implementations, the rear sight module 360 may comprise a base 362 configured to interface with receptacles 364 in the side of the optical sight mount 300; and a windage adjustable rear sight assembly 366. In some implementations, independent of the bolts 314 used to move the clamp member 312 into and out of engagement with the mounting interface of a firearm, the rear sight module 360 may be independently secured to the side of the optical sight mount 300 by a screw 368, or other suitable fastener. In this way, the rear sight module 360 remains fixed to the side of the optical sight mount 300 when the bolts 314 are loosened.

As shown in FIGS. 13 and 14, in some implementations, the base 362 of the rear sight module 360 may include two bosses 370 extending therefrom that are configured to be received within corresponding receptacles 364 located on the side of the optical sight mount 300. In some implementations, each boss 363 extending from the base 362 may have a cylindrical shape, but could be any shape suitable for being received by the corresponding receptacle 364. In some implementations, an opening 372 may extend through the base 362 of the rear sight module 360 for each bolt 314 used to secure it to the interface (i.e., receptacles 364) on the side of the optical sight mount 300. In some implementations, one of these openings 372 may extend through each boss 363 of the base 362.

Figure 17:
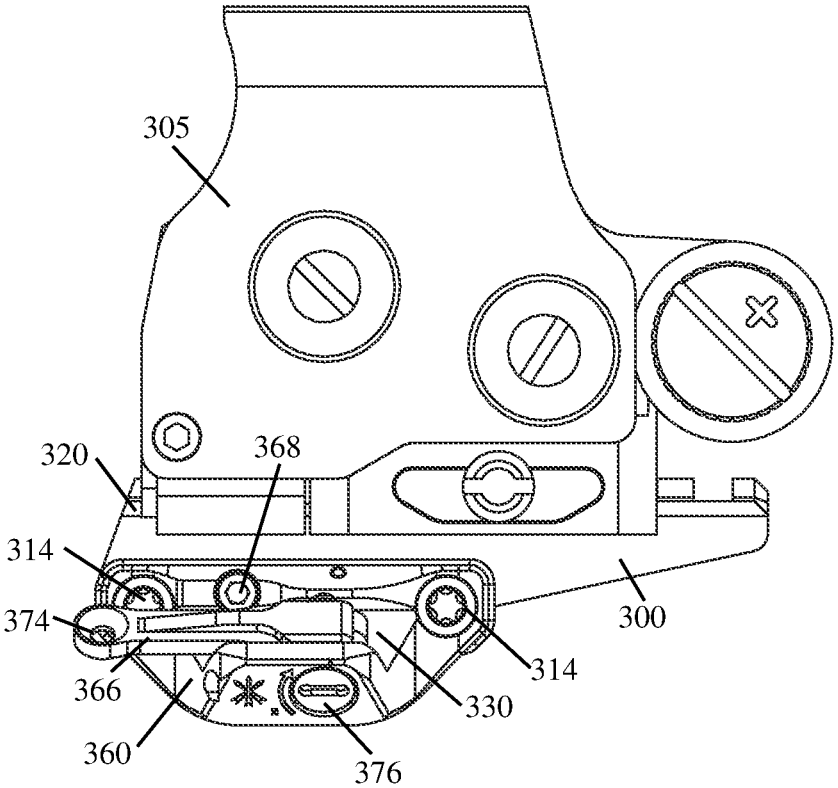
FIG. 17 illustrates a right side view of the optical sight mount 300 shown in FIG. 16.

As shown in FIGS. 13 and 17, the rear sight assembly 366 includes a windage adjustable rear sight 374 that is configured to fold. In some implementations, the rear sight 374 may not be configured to fold. In some implementations, the rear sight 374 defines a sighting aperture, but could be configured to provide a notch. Similar to the windage adjustable rear sight 132 shown in FIGS. 1-3, the rear sight 374 may be positioned on the rear sight module 360 by a windage adjustment screw that includes an adjustment knob 376 (or head) (see, e.g., FIG. 17). Likewise, rotating the adjustment knob 376 clockwise and counterclockwise causes the rear sight 374 to move laterally, within the sight channel 330, on the threaded shaft of the windage adjustment screw.

Figure 16:
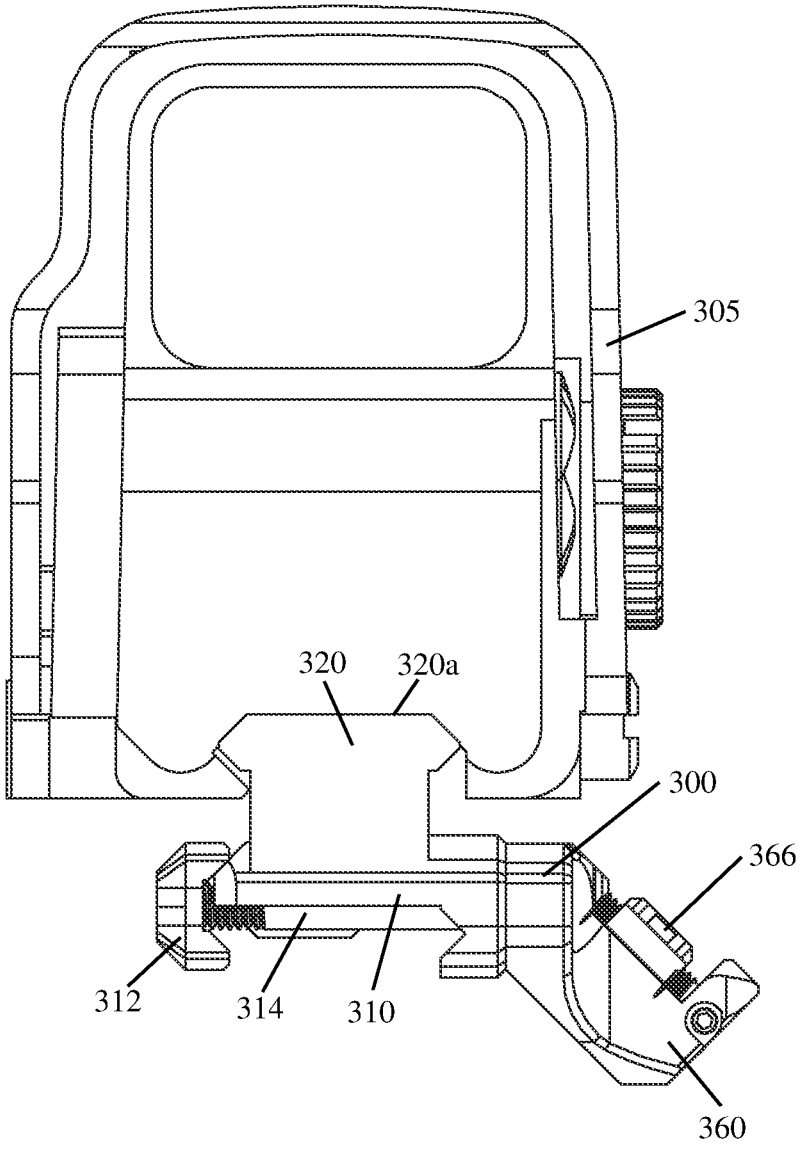
FIG. 16 illustrates a back side view of the optical sight mount 300 shown in FIGS. 13 and 14, wherein an optical sighting device 305 has been secured thereto.

As shown best in FIG. 16, the rear sight module 360 is 45 degrees offset from the top 320*a* of the mounting surface 320, but the degree of lateral offset could be more, or less, than 45 degrees. Typically, the rear sight 374 of the rear sight assembly 366 would be used in conjunction with an offset front sight assembly, well known to those of ordinary skill in the art, to aim the firearm on which the optical sight mount 300 is secured.

In some implementations, similar to the optical sight mount 100 shown in FIGS. 1-3, the optical sight mount 300 could be used in conjunction with one or more implementations of the pivot mount 200 shown in FIGS. 4-6.

FIGS. 18-21 illustrate yet another example implementation of an optical sight mount 400 according to the principles of the present disclosure. In some implementations, the optical sight mount 400 is similar to the optical sight mount 300 discussed above, but comprises a base 410 configured to be secured to, or removed from, a mounting interface of a firearm; scope rings 420 that are configured to receive and engage with a telescopic sighting device 405; and a laterally offset mount 460 for an optical sighting device 490 (e.g., a reflex type sight such as a Trijicon RMR®).

As shown in FIGS. 18-21, in some implementations, the base 410 of the optical sight mount 400 is the same as, or similar to, the base 310 discussed above in connection with the optical sight mount 300 shown in FIGS. 13-17.

Figure 18:
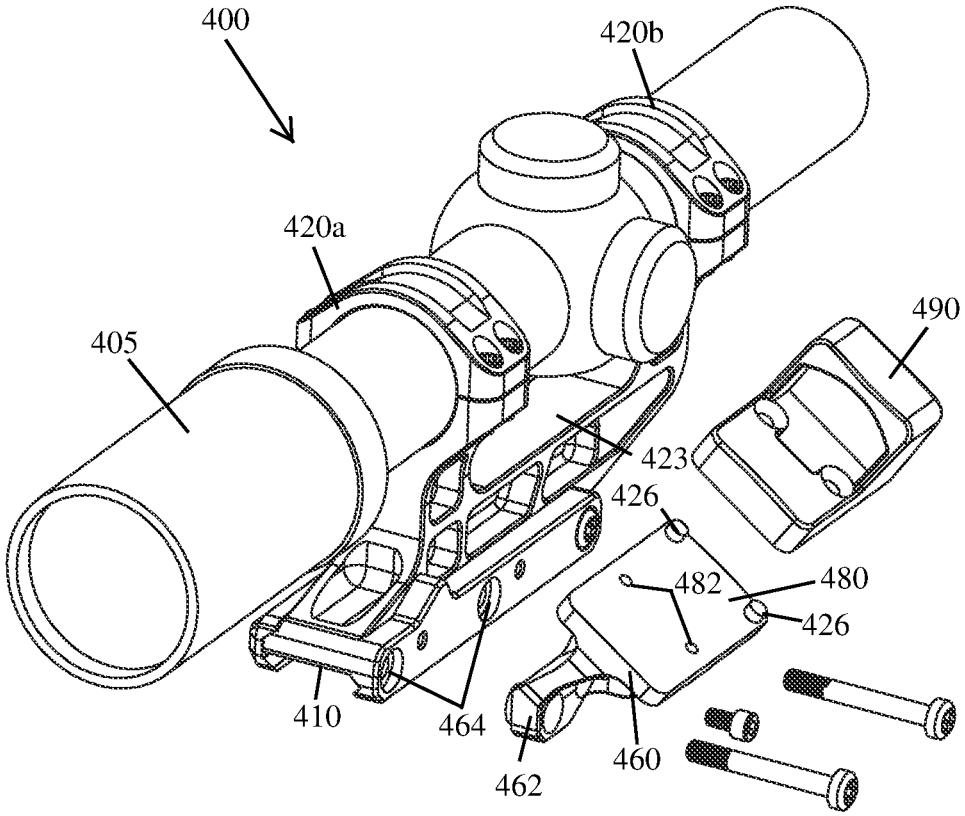
FIGS. 18 and 19 illustrates an exploded view of yet another example optical sight mount 400 according to the principles of the present disclosure.
Figure 19:
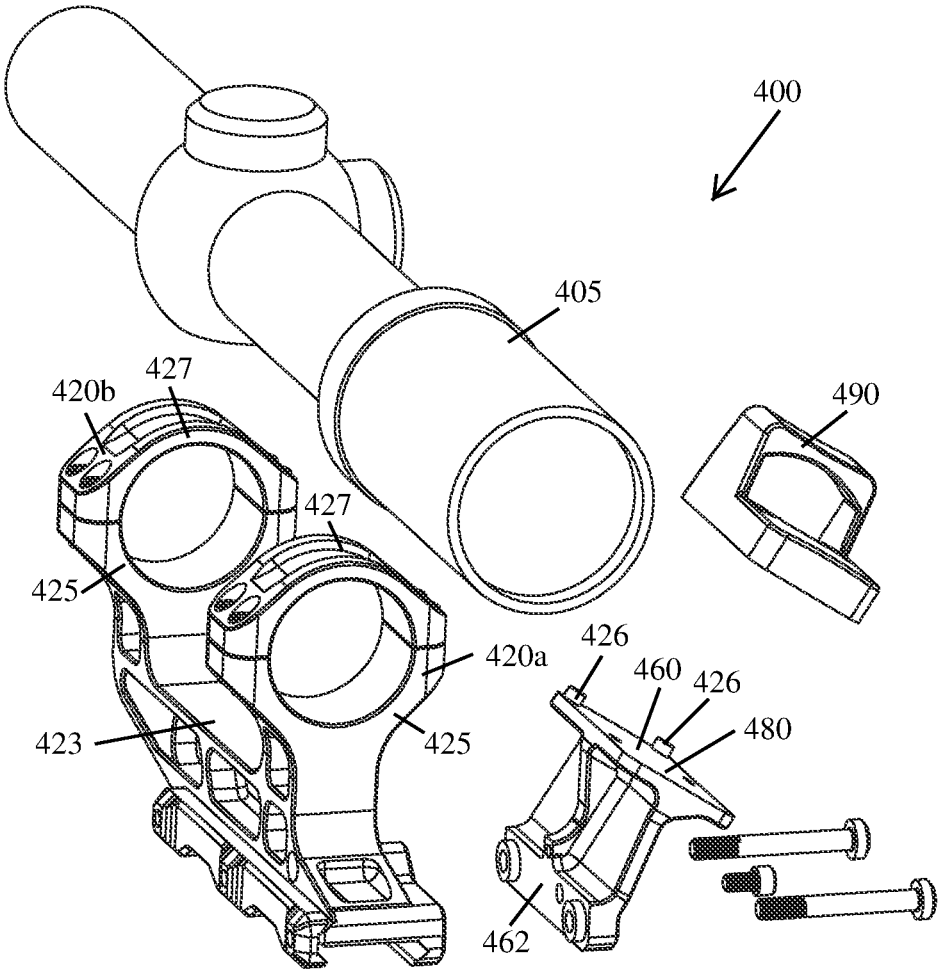

As shown in FIGS. 18 and 19, in some implementations, the scope rings 420 extend from a longitudinally extending bridge 423 which may be an integral portion of the base 410. While conventional scope rings 420 are shown and described, the scope rings 420 could be replaced by any conventional attachment device, known to one of ordinary skill in the art, suitable for securing an optical sighting device to the optical sight mount 400.

As shown in FIG. 19, in some implementations, the lower half 425 of each scope ring 420*a*, 420*b* extends from the bridge 423 of the optical sight mount 400. In some implementations, the upper half 427 of each scope ring 420*a*, 420*b* is secured to the lower half 425 by screws, or other suitable fasteners. In some implementations, when the screws are tightened, the upper half 427 and the lower half 425 of a scope ring 420*a*, 420*b* are drawn together, thereby developing a clamping force sufficient to secure the telescopic sighting device 405 against longitudinal and rotational movement (see, e.g., FIG. 20).

As shown in FIGS. 18 and 19, in some implementations, the laterally offset mount 460 may comprise a base 462 configured to interface with receptacles 464 in the side of the optical sight mount 400; and a mounting surface 480 configured so that an optical sighting device 490 can be secured thereon.

As shown in FIGS. 18-21, in some implementations, the base 462 of the laterally offset mount 460 may be the same as, or similar to, the base 362 of the rear sight module 360 shown in FIGS. 13-17. As a result, the rear sight module 360 and the laterally offset mount 460 may be interchangeably secured to the interface (i.e., the receptacles 364, 464) located on the side of an optical sight mount 300, 400. This allows a user to select the auxiliary sighting module (i.e., a rear sight module 360 or a laterally offset mount 460 with an optical sighting device secured thereon) that best suits their needs.

Figure 20:
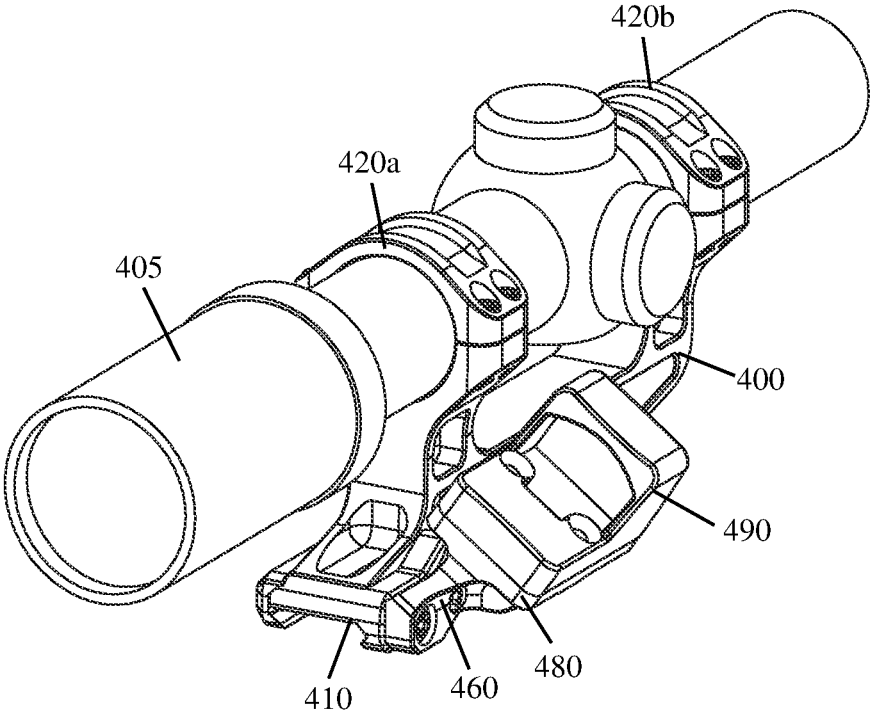
FIG. 20 illustrates a perspective view of the optical sight mount 400 shown in FIGS. 18 and 19; wherein a telescopic sighting device 405 has been attached to the optical sight mount 400 by the scope rings 420 and another optical sighting device 490 has been secured to the laterally offset mount 460.
Figure 21:
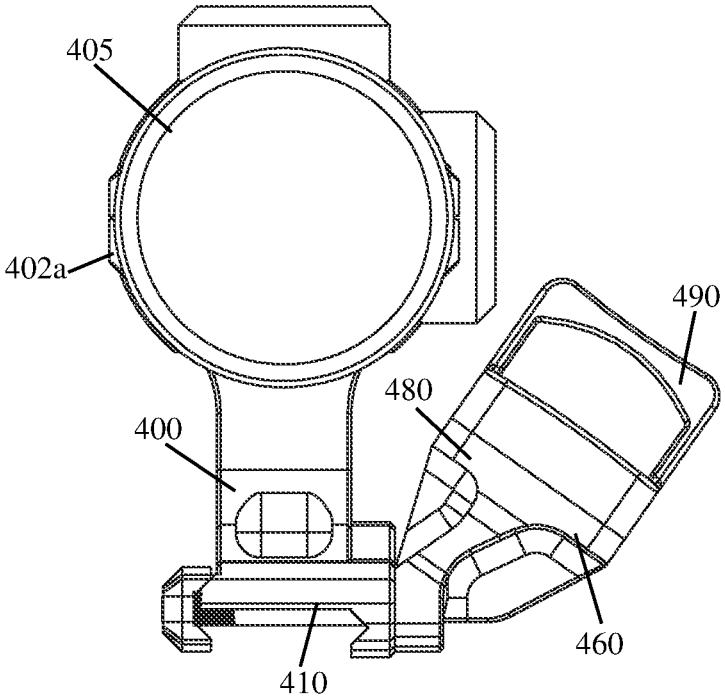
FIG. 21 illustrates a back side view of the optical sight mount 400 shown in FIG. 20.

As shown in FIGS. 20 and 21, in some implementations, the mounting surface 480 of the laterally offset mount 460 may be configured (e.g., contoured, shaped, etc.) to interface with the mount compatible surface (e.g., the bottom side) of any suitably configured optical sighting device. In some implementations, the mounting surface 480 may include one or more threaded openings 482 therein. In this way, fasteners (not shown) may be used to secure the optical sighting device 490 to the mounting surface 480 of the laterally offset mount 460. In some implementations, the mounting surface 480 may include one or more recoil lugs 426 thereon. In some implementations, each recoil lug 426 may be a projection extending from the mounting surface 480 of the laterally offset mount 460 that is configured to interface with a receptacle in the underside of the optical sighting device 490. In this way, the optical sighting device 490 may be prevented from sliding back-and-forth due to the incidental vibration associated with the discharge of a firearm. In some implementations, the mounting surface 480 may not have a recoil lug 426 thereon.

Figure 22:
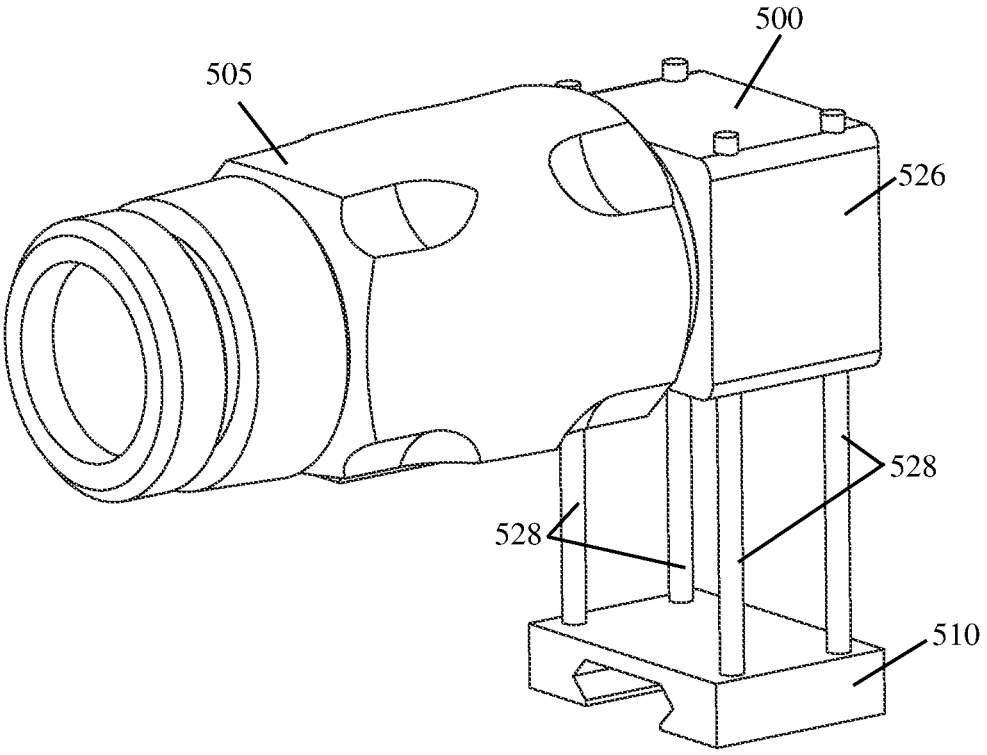
FIG. 22 illustrates still yet another example optical sight mount 500 according to the principles of the present disclosure, wherein an attached optical sighting device 505 is in the operative position.
Figure 23:
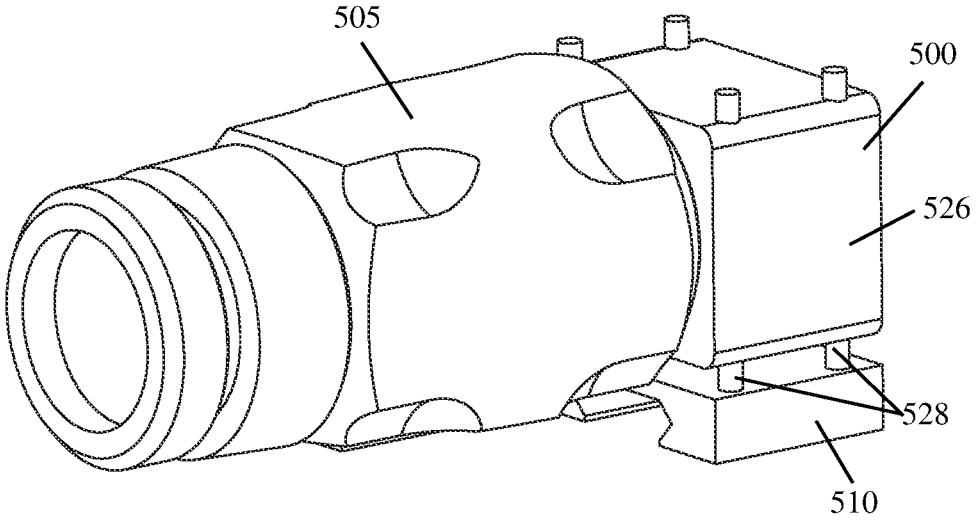
FIG. 23 illustrates the optical sight mount 500 shown in FIG. 22, wherein the attached optical sighting device 505 is in the inoperative position.

FIGS. 22 and 23 illustrate still yet another example implementation of an optical sight mount 500 according to the principles of the present disclosure. In some implementations, the optical sight mount 500 is similar to the pivot mount 200 discussed above but comprises a base 510 configured to be secured to, or removed from, a mounting interface of a firearm (e.g., a MIL-STD-1913 rail); and a sight support member 526, slidably coupled to the base 510, that is configured to move an attached optical sighting device 505 (e.g., an Aimpoint® magnifier) between an operative position (see, e.g., FIG. 22) and an inoperative position (see, e.g., FIG. 23).

In some implementations, the sight support member 526 of the optical sight mount 500 is moveable between an operative position wherein an optical sighting device 505 can be used to sight the firearm on a target and an inoperative position wherein the optical sighting device 505 is positioned below, or vertically offset from, the operative position. In some implementations, the optical sight mount 500 may be configured so that the sight support member 526 linearly moves the attached optical sighting device 505 between two positions on the same, or substantially the same, vertical plane. In this way, when in the operative position and the inoperative position, the optical sighting device 505 is positioned above the mounting interface of a firearm on which it is mounted.

In some implementations, the base 510 of the optical sight mount 500 may be the same as, or similar to, the base 210 described in connection with the pivot mount 200 shown in FIGS. 4-6.

In some implementations, the sight support member 526 may be configured to receive and secure the optical sighting device 505. In some implementations, the sight support member 526 may include an opening configured to secure about the cylindrical barrel portion of the optical sighting device 505 (see, e.g., FIG. 22).

As shown in FIGS. 22 and 23, in some implementations, the sight support member 526 may be configured to slide up and down on vertically oriented posts 528 extending from the base 520. In some implementations, one or more spring-loaded detents may be used to releasably retain the sight support member 226 in the operative position (see, e.g., FIG. 22) and the inoperative position (see, e.g., FIG. 23). It should be understood that, in some implementations, any releasable fastening mechanism known to one of ordinary skill in that art, that is suitable for us as part of an optical sight mount 500, could be used in lieu of spring-loaded detents.

In some implementations, similar to the pivot mount 200, the optical sight mount 500 could be used in conjunction with one or more implementations of the optical sight mounts 100, 300 shown in FIGS. 1-3 and 13-15.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A pivot mount for securing an optical sighting device to a mounting interface aligned with a sighting axis of a firearm, the pivot mount comprising:

a base configured to releasably engage the mounting interface; and a sight support member rotatably coupled to the base;

wherein the sight support member is configured to move the optical sighting device between a first position, in which the optical sighting device is aligned with the sighting axis of the firearm, and a second position, in which the optical sight device is vertically offset below the sighting axis of the firearm and positioned over the mounting interface.

2. The pivot mount of claim 1, wherein the sight support member further comprises a sight attachment device configured to secure the optical sighting device to the sight support member.

3. A pivot mount for securing an optical sighting device to a mounting interface aligned with a sighting axis of a firearm, the pivot mount comprising:

a base configured to releasably engage the mounting interface; and a sight support member rotatably coupled to the base;

wherein the sight support member is configured to move a longitudinal axis of the optical sighting device between a first position, in which the optical sighting device is in a use position, and a second position, in which the optical sighting device is in a storage position, with both the first and the second positions being located substantially on a vertical plane that is substantially co-aligned with the sighting axis of the firearm.

4. The pivot mount of claim 3, wherein the sight support member further comprises a sight attachment device configured to secure the optical sighting device to the sight support member.

5. A pivot mount for securing an optical sighting device to a mounting interface of a firearm, the pivot mount comprising:

a base configured to releasably engage the mounting interface; and a sight support member rotatably coupled to the base;

wherein the sight support member is configured to move the optical sighting device between a first position, in which the optical sighting device is in an operative position, and a second position, in which the optical sighting device is in an inoperative position, with both the first and the second positions placing the optical sighting device over the mounting interface, and in which the second position is located below the first position.

6. The pivot mount of claim 5, wherein the sight support member further comprises a sight attachment device configured to secure the optical sighting device to the sight support member.

* * * * *